US005947773A

United States Patent [19]

Karam

[11] Patent Number: 5,947,773

[45] Date of Patent: Sep. 7, 1999

[54] CONNECTOR WITH ESD PROTECTION

[75] Inventor: Roger A. Karam, Sunnyvale, Calif.

[73] Assignee: Cisco Technology, Inc., San Jose, Calif.

[21] Appl. No.: 08/938,412

[22] Filed: Sep. 26, 1997

[51] Int. Cl.[6] ..... H01R 23/02

[52] U.S. Cl. ..... 439/676; 439/607

[58] Field of Search ..... 439/607, 610, 439/620, 676, 389–425

[56] References Cited

U.S. PATENT DOCUMENTS

| | | | |
|---|---|---|---|
| 4,223,368 | 9/1980 | Dattilo . | |
| 4,477,134 | 10/1984 | Wright . | |
| 4,677,520 | 6/1987 | Price . | |
| 5,031,076 | 7/1991 | Kiku . | |
| 5,059,140 | 10/1991 | Philippson et al. | 439/607 |
| 5,087,210 | 2/1992 | Myers et al. | 439/425 |
| 5,147,223 | 9/1992 | Black . | |
| 5,161,991 | 11/1992 | Bauer . | |
| 5,164,880 | 11/1992 | Cronin . | |
| 5,167,516 | 12/1992 | Tan et al. . | |
| 5,224,878 | 7/1993 | Lurie et al. . | |
| 5,256,074 | 10/1993 | Tan et al. . | |
| 5,256,085 | 10/1993 | Ian et al. . | |
| 5,268,592 | 12/1993 | Bellamy et al. . | |
| 5,342,220 | 8/1994 | Kodama | 439/607 |
| 5,357,402 | 10/1994 | Anholt . | |
| 5,405,000 | 4/1995 | Hagedon . | |
| 5,532,901 | 7/1996 | Hawkins et al. . | |
| 5,537,294 | 7/1996 | Siwinski . | |
| 5,563,450 | 10/1996 | Bader . | |
| 5,567,168 | 10/1996 | Marsh et al. . | |
| 5,654,860 | 8/1997 | Casper et al. . | |

*Primary Examiner*—Lincoln Donovan
*Attorney, Agent, or Firm*—Jay Chesavage

[57] ABSTRACT

A connector having ESD protection is disclosed having a housing, and a first and second set of connector contacts. First set of connector contacts provide discharge of static charge prior to the engagement of second set of connector contacts. Connector may be adapted to provide protection against static charge transfer in applications ranging from an RJ-45 connector realization to a PCB edge connector application.

12 Claims, 5 Drawing Sheets

Side View

Side View

Front View

Front View

Side View

Side View

CONNECTOR WITH ESD PROTECTION

FIELD OF THE INVENTION

The current invention applies to the field of electrical connectors, particularly those connectors used in equipment which is sensitive to electro-static discharge (ESD).

BACKGROUND OF THE INVENTION

Electrical connectors are used for the completion of electrical circuits between different pieces of electrical equipment. Often, the equipment receiving such an electrical connection is susceptible to static discharge, known as electro-static discharge, or ESD. ESD is a serious problem in modern electrical equipment. The current developed between two conductive surfaces having different charges is:

$$i = \frac{\partial Q}{\partial t}$$

As can be seen from this equation, the maximum developed current is related to the difference in charge between the two surfaces. In the case of two conductors of different charge coming into contact, the equation would indicate unlimited current flow. In practice, there are actually two limiting factors of interest. The first limiting factor is the resistance between the two conductors. In this case, where the charge developed is applied across the input of a sensitive electron device, the device itself may be the source of this resistance, and the analysis of this dissipation is complicated by the highly non-linear characteristics of most modern electron device. The second limiting factor is the absolute energy available for destructive device breakdown. The energy U in a charge Q present in a capacitor having capacitance C is $$U = \frac{Q^2}{2C}$$

With modern small device geometries, this device breakdown energy is low, and will become lower as more sensitive devices and higher frequency devices utilizing these smaller device geometries become available.

Prior art patents have disclosed different classes of protection. These will be described in terms of the scope of protection. The first class of protection represents additions to integrated circuits to make them more ESD resistant. Examples are U.S. Pat. Nos. 5,532,901 and 5,654,860 for protective devices to be incorporated into an integrated circuit. U.S. Pat. No. 4,677,520 is for a protective device which operates external to an IC, but within the package of the IC. Another class described offers protection to the printed circuit boards which ordinarily interconnect many of the previously described integrated circuits. U.S. Pat. Nos. 5,563,450, 4,223,368, and 5,164,880, and 5,537,294 describe grounding clips to be used to protect the circuit boards from the application of ESD to these exposed connectors. These techniques are useful for increasing the immunity of semiconductor devices to ESD. Another class of disclosure represents packaging intended to prevent the application of ESD to the printed circuit board during handling, such as U.S. Pat. No. 5,405,000. Another class of protection is for electronics enclosed in a removable cartridge. U.S. Pat. No. 5,031,076 discloses the inclusion of a conductive material surrounding the enclosed electronics, and U.S. Pat. No. 5,357,402 discloses a grounding spring for the discharge of static charge. Another class of prior art is directed to connectors which operate to minimize the transfer of static charge into the sensitive signal pins. This is accomplished through the introduction of an conductive shield around the connector, wherein the signal pins are concealed within this shield to encourage charge to travel through the exposed conductive shield rather than sensitive signal pins. Examples of such art include U.S. Pat. Nos. 5,161,991, 5,167,516, 5,224,878, 5,256,074, 5,256,085, and 5,342,220. These devices do not address the removal of charge present on signal lines, but instead provide some type of discharge mechanism between the signal pins and conductive shield. Examples of this include U.S. Pat. Nos. 5,147,223, 5,567,168. A final class of ESD protection is disclosed in U.S. Pat. No. 5,268,592 for which a staggered length set of connector pins are used to activate FET switches to enable signals at different times, selected in accordance to when the risk of ESD transfer is minimized.

OBJECTS OF THE INVENTION

A first object of the invention is to provide a connector with high tolerance to ESD. A second object of the invention is to cause static charge to be removed from signal lines before completion of an electrical circuit, thereby protecting the signal lines from transferring ESD to the devices which use these pins as signal inputs or outputs. A third object is to provide a connector which can be used in a variety of different situations, including but not limited to a plug and jack, and a printed circuit board and an edge connector.

SUMMARY OF THE INVENTION

The present invention is directed to a class of connector which removes static charge from signal lines prior to making the electrical connection with these signal lines. The removal of static charge prior to electrical connection to signal lines protects signal circuits associated with these signal lines. This is achieved through a primary set of grounded discharge conductors which remove stray charge prior to mating with a secondary set of conductors, which are then utilized in the typical manner. The connector comprises a plug and jack combination, wherein the plug has exposed connector contacts, and the jack has internal non-exposed contacts. The connector plug is typical of and compatible with other plugs commonly used for this application. The jack contains two sets of internal contacts. The outermost jack connector contacts make individual contact with the contacts of the plug. This first set of jack contacts may contain dissipation resistors, a non-linear resistance material, or any other means for dissipation of this static charge energy. When the plug is first inserted into this jack, the plug contacts make a connection with the first set of jack contacts, thereby discharging harmlessly the charge available on the cable. As the plug is further inserted into the jack, connectivity is lost with the first set of contacts, and the signal conductors are now in charge equilibrium with the second set of jack contacts, such that when contact is established with this second set of jack contacts, there is no further transfer of energy, and the sensitive circuitry is protected from exposure to any transfer of static charge.

DETAILED DESCRIPTION OF THE INVENTION

Figure 1:
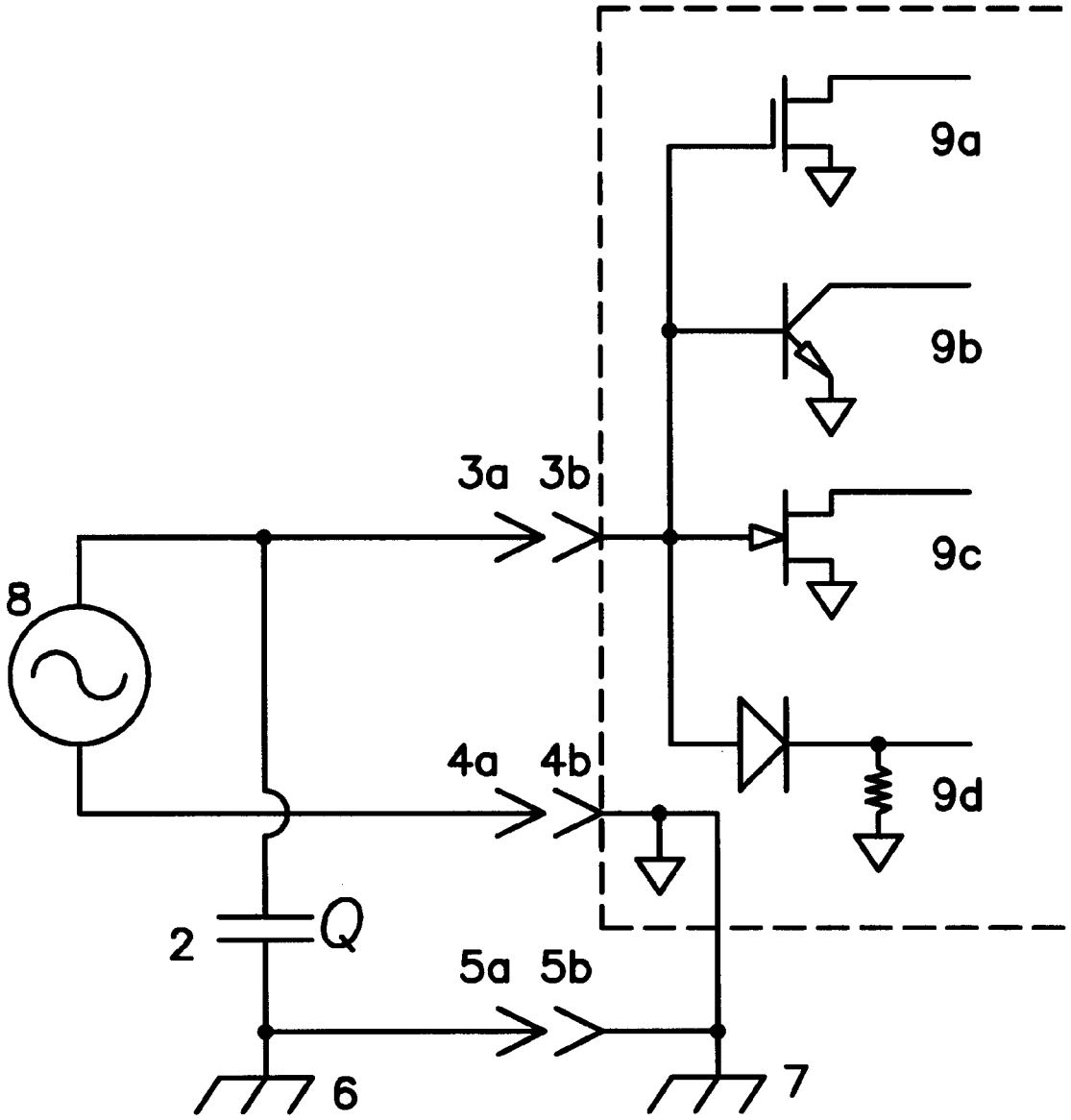
Figure 1 Prior Art
FIG. 1 is a schematic diagram showing generically a connector, a charge source, and devices needing protection.

FIG. 1 is a schematic view of the connector ESD problem, showing the connector plug contacts 3*a*, 4*a*, and 5*a* and connector jack contacts 3*b*, 4*b*, and 5*b*. In the figure, connector contacts 3*a* and 3*b* comprise a signal line, connector contacts 4*a* and 4*b* comprise a signal return line, and connector contacts 5*a* and 5*b* comprise an earth line, which is also the charge 2 return line between the local earth 7 and the charge source 2 earth 6. Signal source 8 represents the signal which is intended to be applied across signal pins 3*a* and 3*b*, and signal return pins 4*a* and 4*b*. Semiconductor signal processing elements are normally present at these signal input connectors, as seen in Insulated Gate Metal Oxide Semiconductor Field Effect Transistor (IGMOS FET) 9*a*, bipolar transistor 9*b*, junction FET 9*b*, and signal diode 9*d*. As is well known to one skilled in the art, the semiconductor devices described are sensitive to applied voltages, and may begin to breakdown with voltages as low as 3 volts in the case of reverse base-emitter voltage on a bipolar transistor such as 9*b*. Devices 9*a* through 9*d* are shown as examples, and could be any electronic device with ESD breakdown characteristics. Static voltages as represented in charge source 2 may be as high as 10,000 volts. Clearly, a mechanism is needed to dissipate this potential prior to connection to the previously described sensitive electronic devices 9*a* through 9*d*. One such mechanism is to guarantee through mechanical arrangement of connector components that connector pins 5*a* and 5*b* make an electrical connection first, followed by connector pins 4*a* and 4*b*. This assures that charge 2 is dissipated prior to the engagement of signal pins 3*a* and 3*b*, although such discharge current is seen to pass through signal source 8, which is undesirable.

Figure 2A:
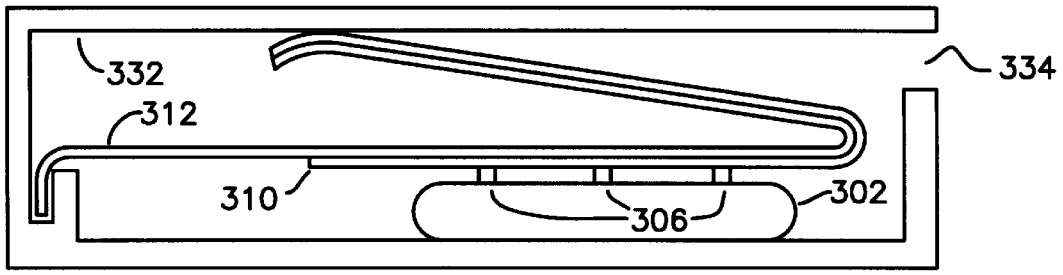
Figure 2a Prior Art
FIGS. 2*a* and 2*b* are a prior art connector.
Figure 2B:
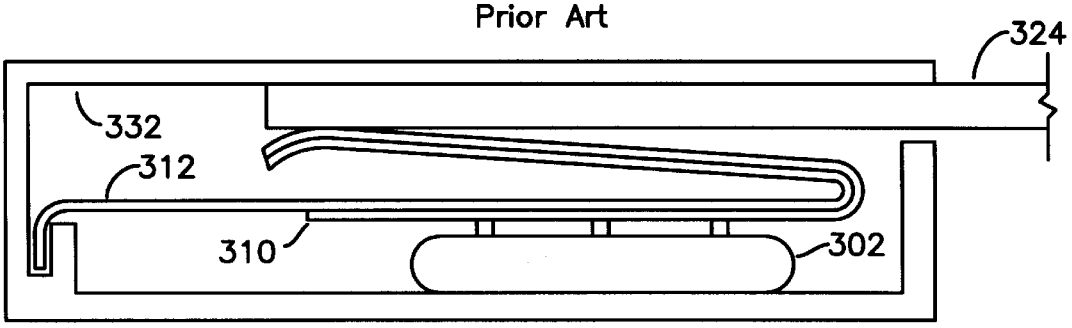
Figure 2b Prior Art

FIGS. 2*a* and 2*b* shows the prior art connector of U.S. Pat. No. 4,477,134, which grounds signal pins when they are not in use. In FIG. 2*a*, ESD sensitive circuit 302 is connected to connector contacts 312, which are all in contact with conductive housing 332, and therefore at equal potential and immune from ESD transfer. When board 324 is inserted, as shown in FIG. 2*b*, each connector contact 312 makes connection with each contact surface present on 324.

Figure 3A:
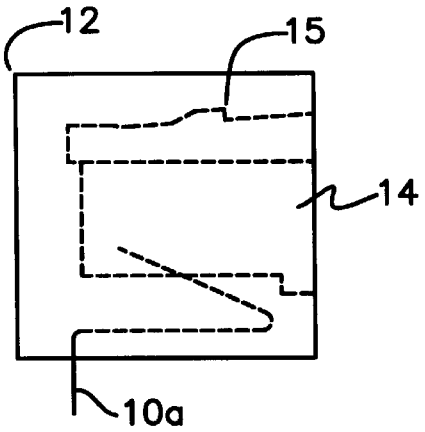
Figure 3a Prior Art
FIG. 3*a* is a side view of a connector jack.
Figure 3C:
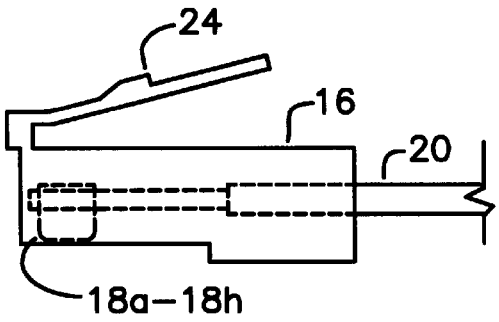
Figure 3c Prior Art
FIG. 3*c* is a side view of a connector plug.
Figure 3B:
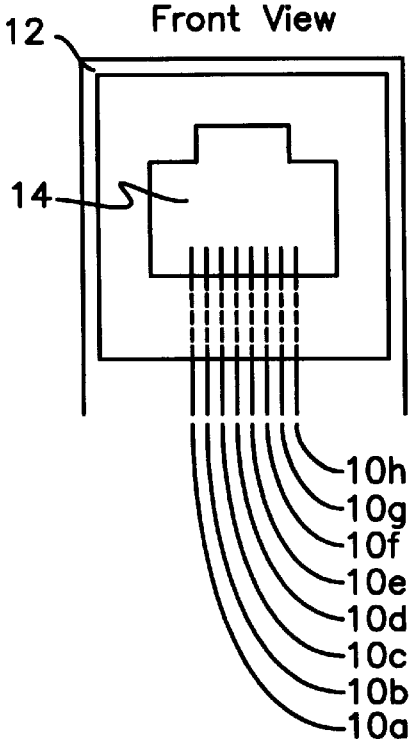
Figure 3b Prior Art
FIG. 3*b* is a front view of a connector jack.
Figure 3D:
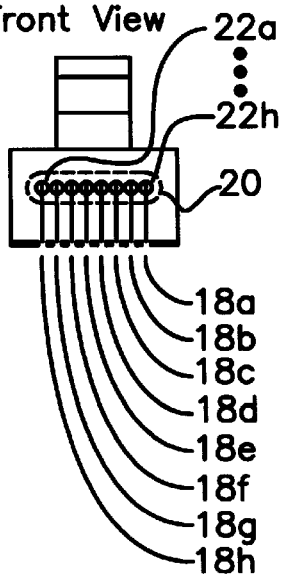
Figure 3d Prior Art
FIG. 3*d* is a front view of a connector plug.

FIGS. 3*a,b,c* and *d* show a typical data communications jack and plug, commonly known as an RJ-45 connector, such as model #555153-1 manufactured by AMP Inc. FIG. 3*a* is the side view of the jack, which comprises a housing 12, a plug receiving area 14, and a set of contact pins 10*a*. FIG. 3*b* shows the front view of the jack. This view shows the previously described housing 12 and receiving area 14, and additionally shows contact pins 10*a,b,c,d,e,f,g,h*, which is typical for the eight signal contact RJ-45 connector. These contact pins are often made from a material with a high spring constant, such as beryllium copper, or phosphor bronze alloy. FIG. 3*c* is the corresponding side view of the mating plug, which comprises a plug housing 16, a set of crimp contacts 18*a* through 18*h*, a signal cable 20, and a spring loaded retaining clip 24, which engages with matching surface 15 in the jack, thereby securing the plug in the fully engaged position. When mated, each of crimp contacts 18*a* through 18*h* is in contact with each of jack contact pins 10*a* through 10*h*. FIG. 3*d* shows the front view of the mating plug, where each crimp connection 18*a,b,c,d,e,f,g,h* makes contact with each of the previously described contact pins 10*a,b,c,d,e,f,g,h*. Cable 20 is now seen to further comprise individual corresponding conductors 22*a,b,c,d,e,f,g*, and *h*, each of which is respectively connected to crimp connectors 18*a* through 18*h*.

Figure 4A:
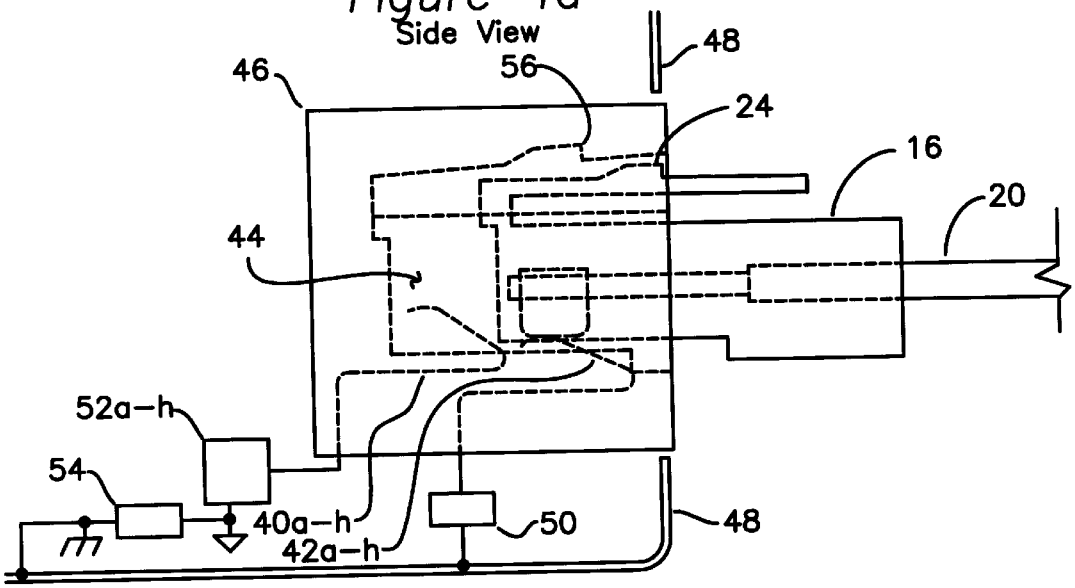
FIG. 4*a* is a side view of the present invention in first position of engagement.
Figure 4B:
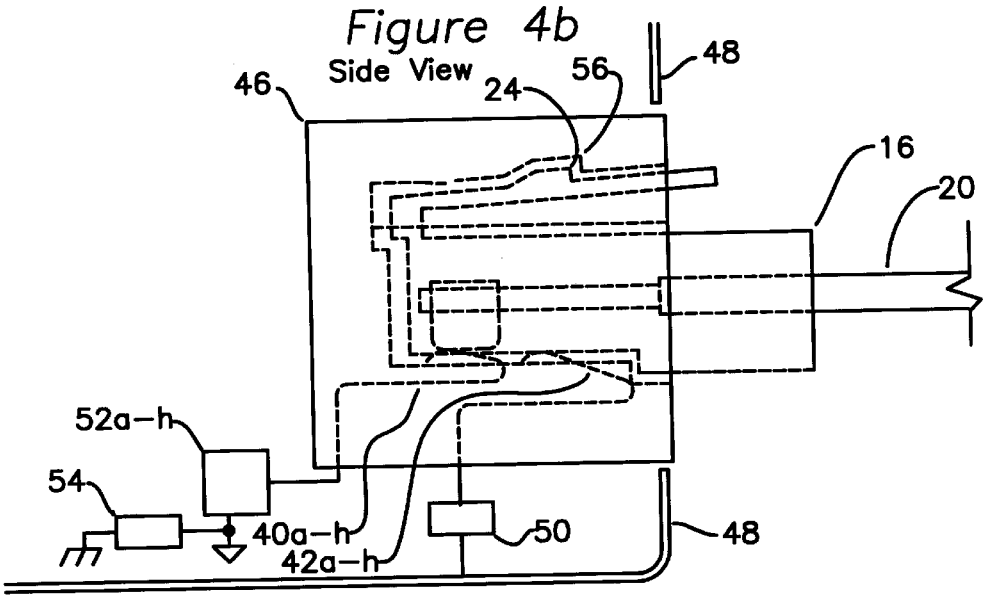
FIG. 4*b* is a side view of the present invention in final position of engagement.

The present invention is shown in FIG. 4*a*. Connector plug 16 is of identical design as previously described in FIGS. 3*c* and 3*d*, and comprises housing 16 with retaining clip 24, a plurality of conductors 22*a* through 22*h* within a cable 20, and a plurality of contacts 18*a* through 18*h*, each contact 18*a* through 18*h* having an electrical connection to each conductor 22*a* through 22*h* in cable 20. Referring again to FIG. 4*a*, there is a connector jack comprising a housing 46, a cavity 44 for receiving connector plug 16, a recess 56 in cavity 44 for receiving retaining clip 24, and two sets of connector contacts 42*a* through 42*h* and 40*a* through 40*h*. The first set of connector contacts 42*a–h* is positioned near the front of the connector housing 46. The second set of connector contacts 40*a* through 40*h* is positioned near the rear of the connector housing 46, in such a manner as to provide exclusive contact between pins 18*a* through 18*h* to either contacts 42*a* through 42*h*, or to contacts 40*a* through 40*h*, but not simultaneously to both. When the plug 16 is first inserted into the jack, as shown in FIG. 4*a*, the connector contacts of plug 16 come in contact with the first set of jack contacts 42*a* through 42*h*, which discharge accumulated ESD through dissipation elements 50*a* thorough 50*h*, as shown in FIG. 4*b*, or alternatively, jack contacts 42*a* through 42*h* could be all tied together and discharge to a single dissipation element 50 as shown in FIG. 4*a*. The plug 16 position during which this contact between plug contacts 18*a* through 18*h* and first contacts 42*a* through 42*h* is referred to as first position engagement, as shown in FIG. 4*a*. Dissipation element 50 is connected between the first set of connector contacts 42*a* through 42*f*, and conductive chassis 48. If connector housing 46 also includes a shield, this may be tied to conductive chassis 48 via a spring clip formed into the shield, or other means known to those skilled in this art. After the initial transfer of charge through jack contacts 42*a* through 42*f*, as the plug is further inserted into cavity 44, plug contacts 18*a* though 18*h* move past and break contact with front connector contacts 42*a* through 42*h*, and thereafter make contact with the rear set of contacts 40*a* through 40*h*, which are the signal contacts. Thereafter, the locking clip 24 engages with matching recess 56, thereby locking the plug into place, and the plug contacts 18*a* through 18*h* maintain connectivity with jack contacts 40*a* through 40*h*. This position is referred to as final position of engagement. Input circuits 52*a* through 52*h* which are connected to jack contacts 40*a* through 40*h* are thereby protected from the ESD energy which was earlier dissipated in dissipation elements 50*a* through 50*h* during first position of engagement.

Figure 5:
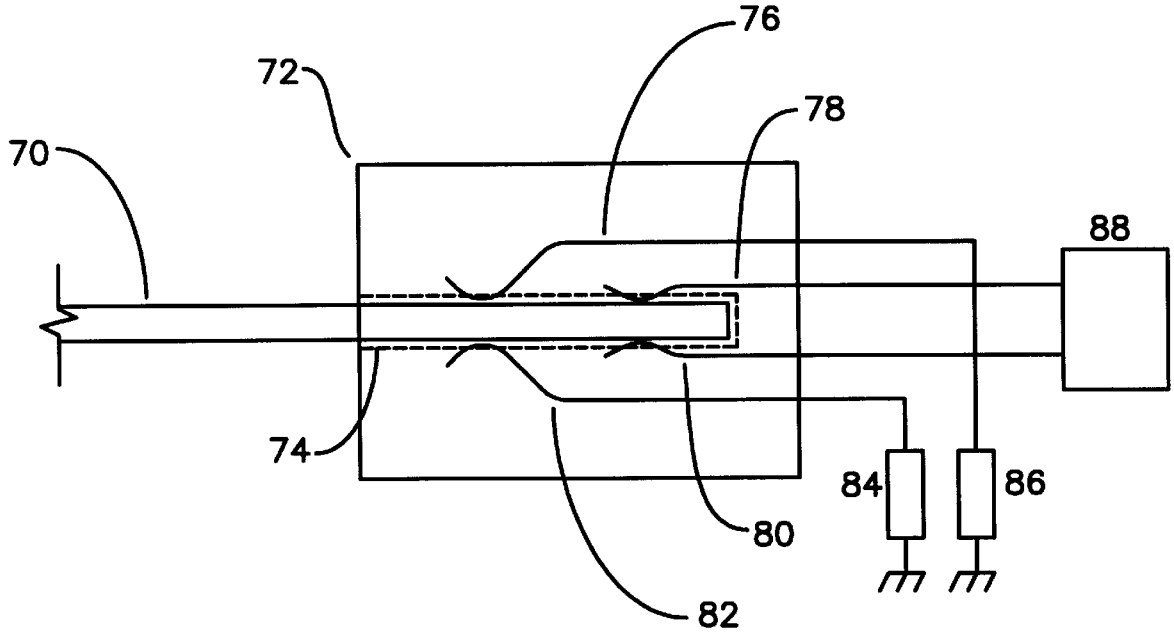
FIG. 5 is a side view of an alternate embodiment for use with printed circuit boards.

FIG. 5 shows an alternate embodiment of the present invention. This connector is optimized for operation as an edge connector for a printed circuit board, which is the type of use shown in prior art FIG. 2. Printed circuit board 70 is of typical design, and includes a plurality of connector contacts directly etched on its substrate material, which is usually copper. Connector housing 72 includes a recess 74 for receiving PCB 70, as well as connector contacts 76, 78, 80, and 82. Contacts 76 and 82 make contact first, and are connected to dissipation means 86 and 84 respectively.

Signal contacts 78 and 80 make contact last, and deliver low level signals without ESD to signal processing circuit 88.

I claim:

1. An electrical connector comprising:

a jack housing having an external cavity for receiving a mating plug, said mating plug comprising a plug housing having at least one plug electrical contact, said external cavity having a first position of engagement with said plug housing when said plug is partially inserted in said external cavity, and a final position of engagement with said plug housing when said plug is fully inserted in said external cavity;

a first set of jack electrical contacts located in said jack housing and extending into said external cavity and making contact with said plug electrical contacts exclusively during said first position of engagement;

a second set of jack electrical contacts located in said jack housing and extending into said external cavity and making contact with said plug electrical contacts exclusively when said plug is in said final position of engagement.

2. The electrical connector of claim 1 wherein said first set of electrical contacts comprises wires formed into planar shapes and inserted into said jack housing.

3. The electrical connector of claim 2 wherein said jack is formed into an RJ-45 housing.

4. The electrical connector of claim 3 wherein said first set of electrical contacts and said second set of electrical contacts are positioned in rows principally perpendicular to the axis of said insertion.

5. The electrical connector of claim 4 wherein at least one of said first set of jack electrical contacts and said second set of jack electrical contacts are formed from beryllium copper or phosphor bronze alloy.

6. The electrical connector of claim 1 wherein said plug comprises an edge connector of a printed circuit board, said printed circuit board having an upper row of contacts and a lower row of contacts, and said jack having said first set of upper jack electrical contacts, said second set of upper jack electrical contacts, a first set of lower jack electrical contacts, and a second set of lower jack electrical contacts.

7. An apparatus for removing static charge from a connector plug comprising:

a conductive enclosure containing devices sensitive to static discharge;

a jack housing having an external cavity for receiving a mating plug, said mating plug comprising a plug housing having at least one plug electrical contact, said external cavity having a first position of engagement with said plug housing when said plug is partially inserted in said external cavity, and a final position of engagement with said plug housing when said plug is fully inserted in said external cavity;

a first set of jack electrical contacts located in said jack housing and extending into said external cavity and making contact with said plug electrical contacts exclusively during said first position of engagement;

a second set of jack electrical contacts located in said jack housing and extending into said external cavity and making contact exclusively with said plug electrical contacts when said plug is in said final position of engagement;

a plurality of dissipation elements electrically connected between said first set of electrical contacts and said conductive enclosure.

8. The electrical connector of claim 7 wherein said first set of electrical contacts comprises wires formed into planar shapes and inserted into said jack housing.

9. The electrical connector of claim 8 wherein said jack is formed into an RJ-45 housing.

10. The electrical connector of claim 9 wherein said first set of electrical contacts and said second set of electrical contacts are positioned in rows principally perpendicular to the axis of said insertion.

11. The electrical connector of claim 10 wherein at least one of said first set of jack electrical contacts and said second set of jack electrical contacts are formed from beryllium copper or phosphor bronze alloy.

12. The discharge apparatus of claim 7 wherein said plug comprises an edge connector of a printed circuit board, said printed circuit board having an upper row of contacts and a lower row of contacts, and said jack having said first set of upper jack electrical contacts, said second set of upper jack electrical contacts, a first set of lower jack electrical contacts, and a second set of lower jack electrical contacts.

* * * * *